US006314604B1

(12) United States Patent
Ahlstrom et al.

(10) Patent No.: US 6,314,604 B1
(45) Date of Patent: Nov. 13, 2001

(54) BRUSH SUPPORT

(75) Inventors: Tom Ahlstrom; Hans Ehrich, both of Stockholm (SE)

(73) Assignee: Anza AB, Bakeryd (SE)

( * ) Notice: Subject to any disclaimer, the term of this patent is extended or adjusted under 35 U.S.C. 154(b) by 0 days.

(21) Appl. No.: 09/485,516

(22) PCT Filed: Jul. 2, 1998

(86) PCT No.: PCT/SE98/01303

§ 371 Date: Mar. 22, 2000

§ 102(e) Date: Mar. 22, 2000

(87) PCT Pub. No.: WO99/08565

PCT Pub. Date: Feb. 25, 1999

(30) Foreign Application Priority Data

Aug. 14, 1997 (SE) ..... 9702928

(51) Int. Cl.[7] ..... A46B 15/00; A46B 17/00

(52) U.S. Cl. ..... 15/159.1; 15/246; 248/688; 248/690; D4/116; D4/135

(58) Field of Search ..... 15/143.1, 159.1, 15/246, 248.1; 248/682, 685, 688, 690–692; D4/116, 132, 135, 138

(56) References Cited

U.S. PATENT DOCUMENTS

| | | | | |
|---|---|---|---|---|
| 286,658 | * | 10/1883 | Warren | 248/688 X |
| 711,678 | * | 10/1902 | Ritz | 15/248.1 X |
| 1,095,226 | * | 5/1914 | Owens | 248/692 |
| 1,284,697 | * | 11/1918 | Johnsen | 248/692 |
| 1,289,171 | * | 12/1918 | Hilton | 248/691 |
| 1,545,279 | * | 7/1925 | Ross | 248/688 |
| 1,700,951 | * | 2/1929 | Power et al. | 248/688 X |
| 1,711,566 | | 5/1929 | Jacobs | 294/55 |
| 1,713,077 | * | 5/1929 | Frizl | 248/691 |
| 1,763,696 | * | 6/1930 | Frenkel | 15/248.1 |
| 1,772,504 | * | 8/1930 | Vrooman | 248/692 |
| 2,723,826 | * | 11/1955 | Zanelli | 248/692 |
| 2,905,419 | | 9/1959 | Carson | 248/110 |
| 3,961,729 | * | 6/1976 | Grimm | 15/246 X |
| 4,757,568 | * | 7/1988 | Jones | 15/246 X |
| 5,406,668 | | 4/1995 | Goodhue | 15/159.1 |

FOREIGN PATENT DOCUMENTS

| | | | | |
|---|---|---|---|---|
| 1073249 | * | 3/1954 | (FR) | 15/246 |
| 7692 | | of 1890 | (GB) . | |
| 223935 | | 12/1968 | (SE) . | |

* cited by examiner

*Primary Examiner*—Mark Spisich
(74) *Attorney, Agent, or Firm*—Ladas & Parry

(57) ABSTRACT

The present invention relates to a support (2) for a paintbrush (1). The support (2) may advantageously be used both when you want to lay down the paint brush on a flat surface and when you want to hang the brush on a bucket. The support (2) consists of an integrated part of the paint brush (1), projecting from the paintbrush in the form of a projection from the paintbrush body. According to the invention, the projection comprises at least two points of support, allowing the paintbrush to rest on these points of support, together with a point of support provided by the paintbrush somewhere along the handle (3). Preferably, the support is located at the head (4) of the paintbrush, at the shoulder (6) of the head (4) close to the handle (3). Furthermore, the support may comprise an arched flange (8), directed along the handle, which can function as a bucket holder.

7 Claims, 1 Drawing Sheet

BRUSH SUPPORT

FIELD OF INVENTION

The present invention relates to a support for a paintbrush. The support may advantageously be used both when you want to lay down the paintbrush on a flat surface and when you want to hang the brush on a bucket. The support consists of an integrated part of the paintbrush, projecting at the head of the paintbrush.

STATE OF THE ART

It is known in the prior art to provide bucket holders for paintbrushes. Such holders are generally in the form of tabs or tinplates projecting from the handle or the head of the paintbrush. The projecting tabs are often rounded in order to follow the shape of a bucket or a paint jar.

When you want lay down a paintbrush equipped with such a bucket holder, however, you are not helped by it, as the holder will not provide adequate support and the paintbrush will tip or roll over, causing the bristle of the paintbrush to contact the surface. This is of course undesirable.

The present invention remedies the above problem by providing a support having two points of support that, together with a further point of support at the handle, provides sufficient support to allow the paintbrush to be laid down onto a surface without tipping or rolling over.

SUMMARY OF THE INVENTION

Thus, the present invention provides a support for a paintbrush in the form of projections from the paintbrush body. According to the invention, the projection provides at least two points of support, allowing the paintbrush to rest against those points of support, together with a point of support provided by the paintbrush somewhere along the handle. Preferably, the support is located at the head of the paintbrush, at the shoulder of the head close to the handle.

Still more preferably, the support furthermore comprises an arched flange, directed along the handle, which may function as a bucket holder.

BRIEF DESCRIPTION OF THE DRAWINGS

The invention will be described in detail below, with reference to the accompanying drawings, of which.

DETAILED DESCRIPTION OF PREFERRED EMBODIMENTS

The drawings show a paintbrush 1 equipped with a support 2 according to the present invention. The paintbrush shown is of the circular type, but it is to be understood that the support according to the invention could as well be used with a flat type of paintbrush.

Figure 1:
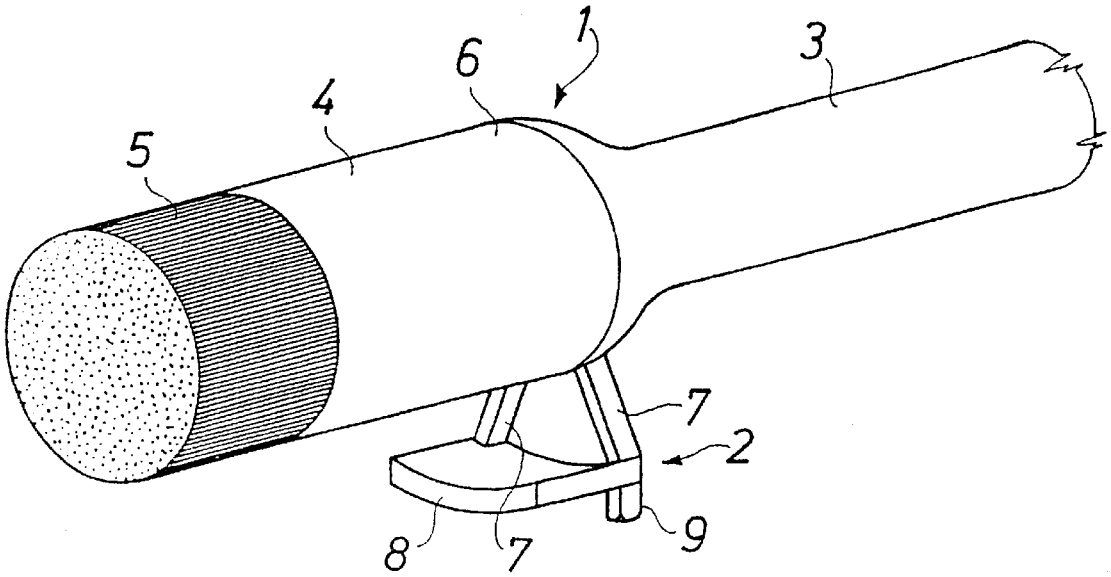
FIG. 1 is a perspective view, diagonally from the front, of the support according to the invention, with the handle partly cut away.

The paintbrush conventionally comprises a handle 3 and a head 4 with bristle 5. At the shoulder 6, where the head 4 passes into the handle 3, a "projection" is provided, which defines the support 2 according to the present invention. The location of the support is selected such that the paintbrush centre of gravity lies behind the support, i.e. somewhere along the handle, even when the bristle 5 of the paintbrush is full of paint. The support 2 at the same time is at a distance from the bristle 5 so as not to be in the way during painting. In FIG. 1, the support is furthermore somewhat exaggerated in size, in order to illustrate the invention more clearly.

Figure 3:
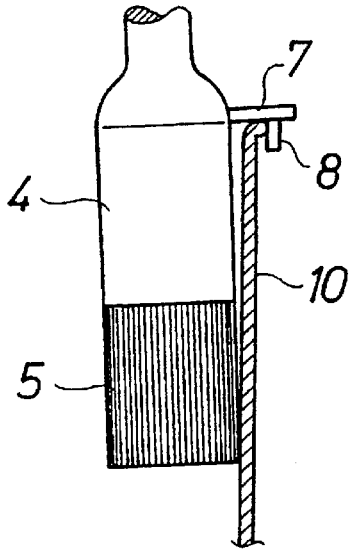
FIG. 3 is a detail side view, partly in cross-section, of the paintbrush hanging on the edge of a paint jar.

The illustrated embodiment of the invention consists of two protruding legs 7, a flange 8 directed along the paintbrush, and two nibs 9, approximately located as extensions of the legs 7. The nibs 9 may be straight as shown, or be of any other suitable shape, as long as two points of support are obtained. One of the nibs is hidden in FIG. 1. The legs 7 are of suitable length, so as to place the flange 8 at a convenient distance away from the head 4 of the paintbrush. When the paintbrush is hung on the edge of a paint jar, as is explained below with reference to FIG. 3, the edge of the paint jar is located between the flange and the head of the paintbrush. The nibs 9 rest against a base when the paintbrush has been put away and thus defines two of the points of support. The third point of support is generally defined by the handle 3 where it rests against the base.

If for any reason it is required to remove the paintbrush support 2, it is simple to cut off the legs close to the head 4 of the paintbrush.

In an alternative embodiment of the invention, the flange 8 is replaced by two narrow, angled sections of the legs 7, so as to make each leg look like an L-shaped hook (not shown). This shape is, however, less stable. It is also conceivable to completely exclude the bucket holder from the support.

As an alternative to the legs 7, a complete tab (not shown) may be used, i.e. there will be no empty space between the legs 7. One disadvantage of that, compared to the most preferred embodiment, is that the support is more difficult to remove and that more material is required to form the support.

Figure 2:
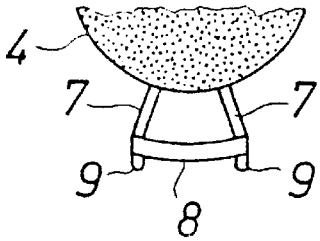
FIG. 2 is a detail front view of the support.

As can be seen, especially from FIGS. 1 and 2, the flange 8 is arched. This is an advantage when the paintbrush is to be hung over the edge of a paint jar. This is specifically shown in FIG. 3, where the edge 10 of the paint jar is shown in cross section with a paintbrush suspended therefrom. The handle has been cut away for clarity. The paintbrush rests with its weight supported on the top of the edge 10 and the brush normally hangs in such a fashion that the head 4 and bristle 5 of the paintbrush rest against the inside of the jar, whereas the flange 8 is supported by the exterior of the jar. Thus, the paintbrush is hanging in a stable manner on the jar.

When the paintbrush is of the flat type, the support is preferably arranged at the narrow side of the paintbrush, to make it easy to hang the paintbrush on the edge of the jar. The paintbrush then has to be placed "on end" when putting it away, but there is normally no problem with the paintbrush tipping over.

The present invention provides an advantageous combination of laying-down support and bucket holder in the form of a support as defined by the accompanying claims. Many embodiments of the support will be evident for the person skilled in the art. The protective scope of the invention is solely limited by what is stated below.

What is claimed is:

1. A paintbrush with an attached support, comprising:

a) a paintbrush comprising a head having a plurality of bristles extending from a first end thereof and a shoulder at a second end thereof with an elongated handle extending from the shoulder end of the head;

b) a support at the shoulder, the support comprising a member extending laterally away from the paintbrush, said member having a first end at and extending from said shoulder and a second end spaced therefrom, an arched flange spaced from the paintbrush and located at the second end of the member, a pair of spaced nibs located at opposite ends of the arched flange; and c) wherein the paintbrush has a center gravity which is located between the point of attachment of the support to the paintbrush and the end of the handle and the pair of nibs and the end of the handle provide three points of support for supporting the paintbrush on a horizontal surface and the arched flange enables the paintbrush to be supported on the edge of a container.

2. A paintbrush according to claim 1 wherein said paintbrush is flat and the support is arranged at the narrow side of said paintbrush.

3. A paintbrush according to claim 1, wherein the member of the support comprises two projecting legs.

4. A paintbrush according to claim 3, wherein the pairs of spaced nibs are arranged in close proximity to the respective points of attachment of the projecting legs to the arched flange.

5. A paintbrush according to claim 1, wherein the member of the support comprises a projecting tab.

6. A paintbrush with an attached support, comprising:

a) a paintbrush comprising a head having a plurality of bristles extending from a first end thereof and a shoulder at a second end thereof with an elongated handle extending from the shoulder end of the head;

b) a support at the shoulder, the support comprising a pair of legs extending laterally away from the paintbrush, said legs having a first end at and extending from said shoulder and a second end spaced therefrom, each leg being formed with a hook spaced from the paintbrush and located at the second end of the respective leg, and c) wherein the paintbrush has a center of gravity which is located between the point of attachment of the support to the paintbrush and the end of the handle and the pair of hooks and the end of the handle provide three points of support for supporting the paintbrush on a horizontal surface and the hooks enable the paintbrush to be supported on the edge of a container.

7. A paintbrush according to claim 6 wherein said paintbrush is flat and the support is arranged at the narrow side of said paintbrush.

* * * * *